US007131311B1

(12) United States Patent
Kihara et al.

(10) Patent No.: US 7,131,311 B1
(45) Date of Patent: Nov. 7, 2006

(54) METHOD OF AND APPARATUS FOR FORMING FORGING BLANK

(75) Inventors: Takashi Kihara, Tochigi-ken (JP); Yoichi Uehara, Fujimino (JP)

(73) Assignee: Honda Motor Co. Ltd., Tokyo (JP)

( * ) Notice: Subject to any disclaimer, the term of this patent is extended or adjusted under 35 U.S.C. 154(b) by 0 days.

(21) Appl. No.: 11/270,524

(22) Filed: Nov. 10, 2005

(51) Int. Cl.
*B21D 22/00* (2006.01)

(52) U.S. Cl. ..... 72/359; 72/344; 72/377

(58) Field of Classification Search ..... 29/893, 29/893.34; 72/344, 352, 353.2, 354.2, 355.2, 72/355.4, 358, 359, 356
See application file for complete search history.

(56) References Cited

U.S. PATENT DOCUMENTS 1,087,583 A * 2/1914 Hansen ..... 72/325
4,074,559 A * 2/1978 Beane et al. ..... 72/354.2
4,198,843 A * 4/1980 Spence ..... 72/356
4,413,496 A * 11/1983 Diemer et al. ..... 72/356
4,649,731 A * 3/1987 Eisenmann ..... 72/352
5,746,085 A * 5/1998 Harada et al. ..... 72/355.6

FOREIGN PATENT DOCUMENTS

| | | |
|---|---|---|
| JP | 04-187340 | 7/1992 |
| JP | 07-323348 | 12/1995 |
| JP | 2000-071046 | 3/2000 |

* cited by examiner

*Primary Examiner*—Lowell A. Larson
*Assistant Examiner*—Teresa M Bonk
(74) *Attorney, Agent, or Firm*—Arent Fox PLLC

(57) ABSTRACT

When an actuator is operated, an upper die is displaced downwardly, pressing a lower surface of a workpiece against a forming surface. After the upper die is displaced upwardly, an ejecting member is displaced upwardly to push the workpiece upwardly by a lower die. As the workpiece is displaced upwardly, an outer circumferential surface of the workpiece is squeezed by a squeezer projecting radially inwardly from an inner circumferential surface of an outer ring.

11 Claims, 5 Drawing Sheets

METHOD OF AND APPARATUS FOR FORMING FORGING BLANK

BACKGROUND OF THE INVENTION

1. Field of the Invention

The present invention relates to a method of and an apparatus for forming a forging blank to increase the accuracy of a forged product, reduce the manufacturing cost of the forged product, and reduce the amount of chips produced when the forged product is machined.

2. Description of the Related Art

There has heretofore been known a method of forming a forging blank of metal to be forged to a desired shape under a pressure applied thereto (see, for example, Japanese Laid-Open Patent Publication No. 2000-71046). When the forging blank is forged into a forged product, it is generally difficult to obtain desired dimensional accuracy. It is customary, therefore, to subsequently machine the forged product to desired dimensional accuracy.

However, the process of additionally machining the forged product to desired dimensional accuracy results in an increased number of manufacturing steps and a large amount of chips cut off from the machined product.

The machining process is time-consuming to perform and hence not efficient. Consequently, in order to increase the production efficiency, it is necessary to employ a plurality of machining tools for machining a plurality of forged products substantially at the same time. However, because the machining tools are expensive, the cost required for facility investments is increased, and the increased cost also increases the price of the final products.

SUMMARY OF THE INVENTION

It is a general object of the present invention to provide a method of and an apparatus for forming a forging blank to increase the dimensional accuracy of a forged product and minimize the number of subsequently required machining steps, thereby reducing the cost of the forged product and the amount of chips produced when the forged product is machined.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
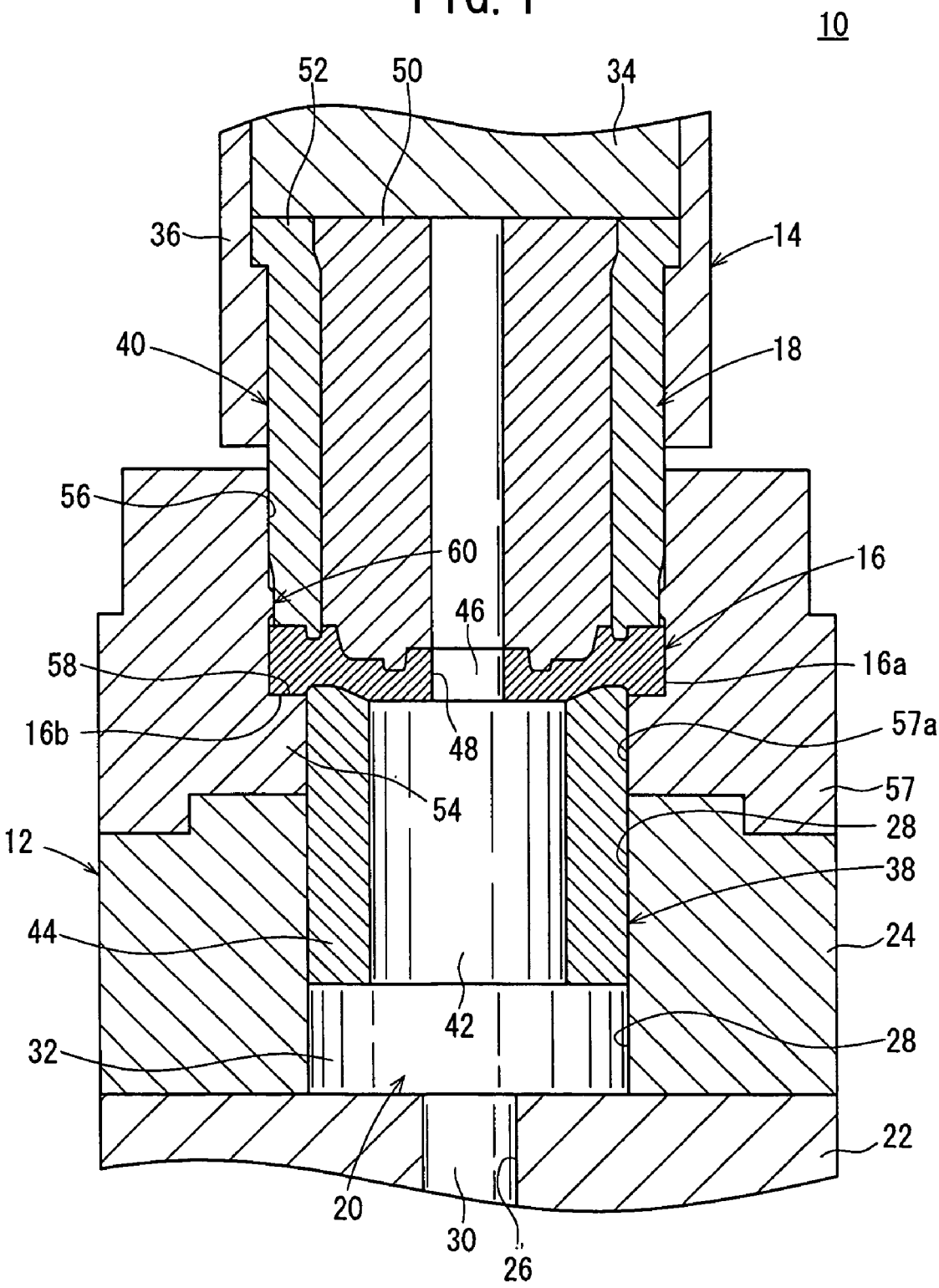
FIG. 1 is a fragmentary vertical cross-sectional view of an apparatus for forming a forging blank according to an embodiment of the present invention.

FIG. 1 shows in fragmentary vertical cross section an apparatus 10 for forming a forging blank according to an embodiment of the present invention.

As shown in FIG. 1, the apparatus 10 comprises a body assembly 12, an actuator 14 which can be displaced in an axial direction thereof when pressed by a drive source (not shown), a die assembly 18 for placing a workpiece 16 such as a transmission gear to be forged therein, and an ejecting member 20 for ejecting a lower die 38 of the die assembly 18 upwardly.

The body assembly 12 has a base 24 mounted on an upper surface of a foundation 22 and housing the lower die 38 therein. The foundation 22 has a through hole 26 defined substantially centrally therein and extending along the axial direction of the body assembly 12. The base 24 has a first through hole 28 defined therein which is greater in diameter than the through hole 26. The through hole 26 and the first through hole 28 are held in communication with each other.

The ejecting member 20, which is of substantially T-shaped cross section, has a shaft 30 axially displaceably disposed in the through hole 26. A flange 32 disposed on the upper end of the shaft 30 is disposed in the first through hole 28.

When a drive source, not shown, connected to the ejecting member 20 is operated, the shaft 30 of the ejecting member 20 is pushed axially upwardly to displace the flange 32 upwardly in the first through hole 28. The flange 32 has an outer diameter which is substantially the same as the inner diameter of the first through hole 28.

The actuator 14 comprises a disk-shaped plate member 34 coupled to the non-illustrated drive source, and a holder 36 disposed around the plate member 34 and holding therein an upper die 40 of the die assembly 18. When the non-illustrated drive source is operated, the plate member 34 and the holder 36 are displaced axially in unison with each other.

The die assembly 18 includes the lower die 38 held against the flange 32 of the ejecting member 20 and displaceable axially in the base 24, the upper die 40 engaged by the holder 36 of the actuator 14 and projecting downwardly therefrom, and an outer ring (die) 57 engaging an upper portion of the base 24.

The lower die 38 comprises a first lower die 42 disposed substantially centrally in the base 24 and the outer ring 57, and a second lower die 44 disposed around and adjacent to the first lower die 42. The first lower die 42 is disposed in the first through hole 28 in the base 24 and a second through hole 57*a* defined in the outer ring 57. The second lower die 44 is axially displaceable along the inner circumferential surfaces of the first and second through holes 28, 57*a*.

The first lower die 42 and the second lower die 44 have respective lower surfaces held against the upper surface of the flange 32 of the ejecting member 20. The first lower die 42 and the second lower die 44 are axially displaced when the ejecting member 20 is axially displaced.

The first lower die 42 is substantially in the form of a cylinder and has a guide 46 projecting a predetermined distance upwardly from an upper end face thereof which faces the upper die 40. The guide 46 comprises a cylinder which is smaller in diameter than the first lower die 42.

When the workpiece 16 is loaded in the outer ring 57, the guide 46 is inserted in a hole 48 that is defined substantially centrally in the workpiece 16. The guide 46 has a diameter substantially equal to or slightly smaller than the diameter of the hole 48 in the workpiece 16. The guide 46 is disposed substantially centrally on the first lower die 42 coaxially therewith.

When the guide 46 is inserted in the hole 48 in the workpiece 16, the workpiece 16 is radially positioned in the outer ring 57. As a result, a clearance 66 (see FIG. 2) is defined substantially uniformly between an entire outer circumferential surface 16*a* of the workpiece 16 and an inner circumferential surface 56 of the outer ring 57.

The second lower die 44 is substantially in the form of a hollow cylinder and has an inner circumferential surface held against an outer circumferential surface of the first lower die 42. The second lower die 44 has an outer circumferential surface slidably held against the inner circumferential surfaces of the first and second through holes 28, 57*a*.

The first lower die 42 and the second lower die 44 have respective upper surfaces that are shaped complementarily to a lower end surface of the workpiece 16 which is placed thereon.

The upper die 40 has an upper surface held against the plate member 34. The upper die 40 comprises a first upper die 50 disposed therein and a second upper die 52 disposed around and adjacent to the first upper die 50 and having an outer circumferential surface engaged by the holder 36 of the actuator 14.

The first upper die 50 is substantially in the form of a hollow cylinder and has an outer circumferential surface engaged by the second upper die 52.

The second upper die 52 is substantially in the form of a hollow cylinder having a diameter increasing radially outwardly of the first upper die 50. The second upper die 52 has an inner circumferential surface engaging the outer circumferential surface of the first upper die 50 and an outer circumferential surface engaged by the holder 36. Since the first upper die 50 and the second upper die 52 are engaged with the holder 36 while being held against the lower surface of the plate member 34, the first upper die 50 and the second upper die 52 are axially displaced in unison with each other when the plate member 34 and the holder 36 are axially displaced.

The first upper die 50 and the second upper die 52 have respective lower surfaces that are shaped complementarily to an upper end surface of the workpiece 16 which is brought into contact with the lower surfaces when the non-illustrated drive source is operated. Specifically, since the first upper die 50 is held against an inner area of the upper surface of the workpiece 16, the lower surface of the first upper die 50 is shaped complementarily to the inner area of the upper surface of the workpiece 16. Since the second upper die 52 is held against an outer area of the upper surface of the workpiece 16, the lower surface of the second upper die 52 is shaped complementarily to the outer area of the upper surface of the workpiece 16.

The outer ring 57 has an annular ledge 54 projecting radially inwardly from an inner circumferential surface thereof toward the lower die 38. The ledge 54 has an inner circumferential surface defining the second through hole 57*a* in the outer ring 57.

The ledge 54 has an upper flat forming surface (placing surface) 58 which is substantially perpendicular to the inner circumferential surface 56 of the outer ring 57. The inner circumferential surface 56 of the outer ring 57 has an annular squeezer 60 disposed near the forming surface 58, the squeezer 60 extending circumferentially therealong and projecting radially inwardly. The inner circumferential surface 56 of the outer ring 57 and the first and second lower dies 42, 44 of the lower die 38 jointly define a workpiece cavity 68 (see FIG. 2) in which the workpiece 16 is loaded.

Figure 2:
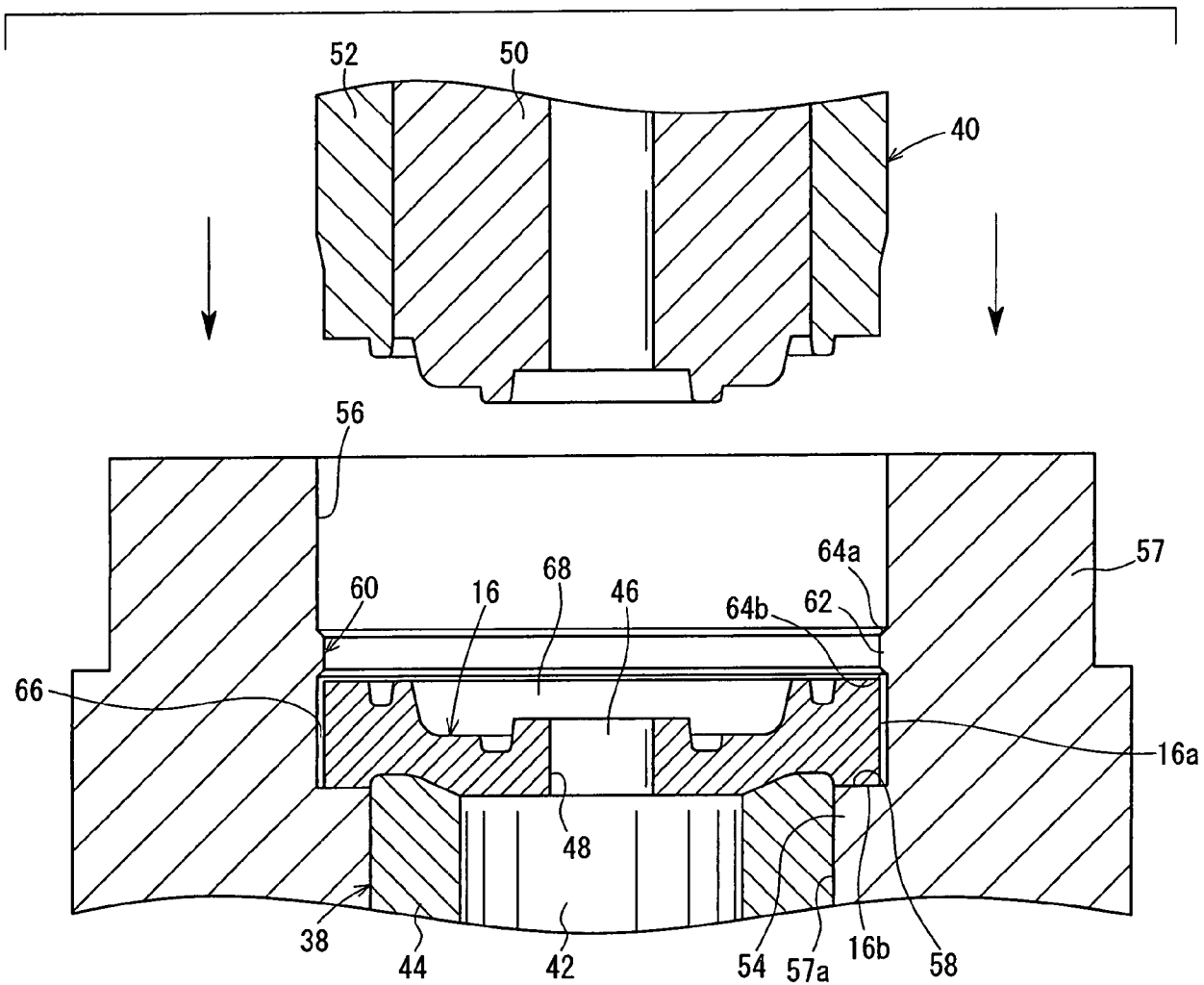
FIG. 2 is an enlarged fragmentary vertical cross-sectional view showing the manner in which an upper die illustrated in FIG. 1 is lifted upwardly and a workpiece is loaded into an outer ring.

The squeezer 60 projects a substantially uniform distance from the inner circumferential surface 56 of the outer ring 57. As shown in FIG. 2, the squeezer 60 has a flat surface 62 which is substantially parallel to the inner circumferential surface 56 and a pair of tapered surfaces 64*a*, 64*b* disposed respectively above and below the forming surface 58 along the axial direction of the outer ring 57 and spreading from the flat surface 62 progressively toward the inner circumferential surface 56. The flat surface 62 of the squeezer 60 has an inner diameter slightly greater than the outside diameter of the workpiece 16. Therefore, when the workpiece 16 is loaded into the outer ring 57, the workpiece 16 is not obstructed by the squeezer 60.

The inner diameter of the squeezer 60 is the same as the outside diameter of the workpiece 16 which has been formed by the apparatus 10.

When the workpiece 16 is loaded in the outer ring 57, the inner circumferential surface 56 of the outer ring 57 and the outer circumferential surface 16*a* of the workpiece 16 are radially spaced apart from each other by the clearance 66 formed therebetween (see FIG. 2).

When the workpiece 16 is loaded in the outer ring 57 and the workpiece 16 has a lower surface 16*b* held against the forming surface 58, the lower tapered surface 64*b* of the squeezer 60 is axially spaced a predetermined distance from the upper surface of the workpiece 16. Stated otherwise, the squeezer 60 is positioned out of contact with the workpiece 16 when the workpiece 16 is loaded in the outer ring 57 (see FIG. 2).

The apparatus 10 for forming a forging blank according to the embodiment of the present invention is basically constructed as described above. Operation and advantages of the apparatus 10 will be described in detail below. The apparatus 10 is in its initial position when the upper die 40 is displaced upwardly by the actuator 14, as shown in FIG. 2.

First, as shown in FIG. 2, the workpiece 16 as a forged product is loaded into the workpiece cavity 68 surrounded by the outer ring 57 and the lower die 38. The guide 46 is inserted into the hole 48 in the workpiece 16, and the workpiece 16 is placed on the upper surfaces of the first lower die 42 and the second lower die 44. Specifically, the lower surface 16*b* of the workpiece 16 is held against the forming surface 58.

When the non-illustrated drive source is energized, the actuator 14 is displaced axially downwardly until the lower surfaces of the first upper die 50 and the second upper die 52 are brought into contact with the upper surface of the workpiece 16.

Figure 3:
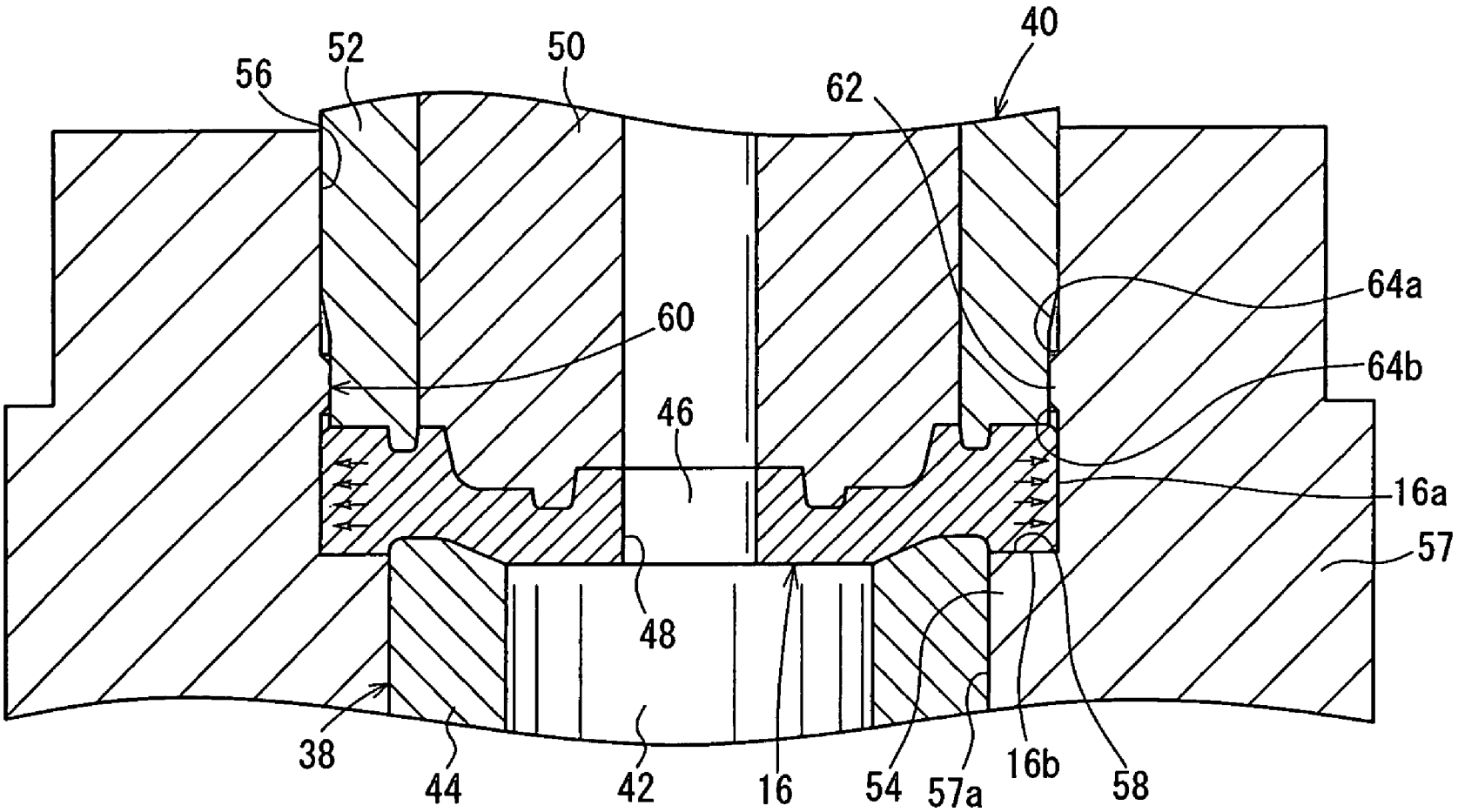
FIG. 3 is an enlarged fragmentary vertical cross-sectional view showing the manner in which the upper die illustrated in FIG. 2 is displaced downwardly and presses the workpiece.

The actuator 14 is further displaced downwardly to press the lower portions of the first upper die 50 and the second upper die 52 into the workpiece 16, causing the material of the outer circumferential area of the workpiece 16 to flow into the clearance 66 between the outer ring 57 and the workpiece 16. The clearance 66 is now filled with the material of the workpiece 16 (see FIG. 3).

As the first upper die 50 and the second upper die 52 press the workpiece 16, the lower surface 16*b* of the workpiece 16 is pressed against the forming surface 58 and shaped into a flat surface by the forming surface 58. Because the inner circumferential surface 56 of the outer ring 57 and the forming surface 58 of the ledge 54 of the outer ring 57 are substantially perpendicular to each other, the outer circumferential surface 16*a* of the workpiece 16 which has expanded to contact the inner circumferential surface 56 forms a right angle (90°) with the lower surface 16*b* of the workpiece 16 which has been formed by the forming surface 58.

Stated otherwise, by accurately forming the inner circumferential surface 56 and the forming surface 58 of the outer ring 57 substantially perpendicularly to each other, the perpendicularity between the outer circumferential surface 16*a* and the lower surface 16*b* of the formed workpiece 16 is reliably increased. It is thus easy to obtain the formed workpiece 16 having perpendicularity.

Figure 4:
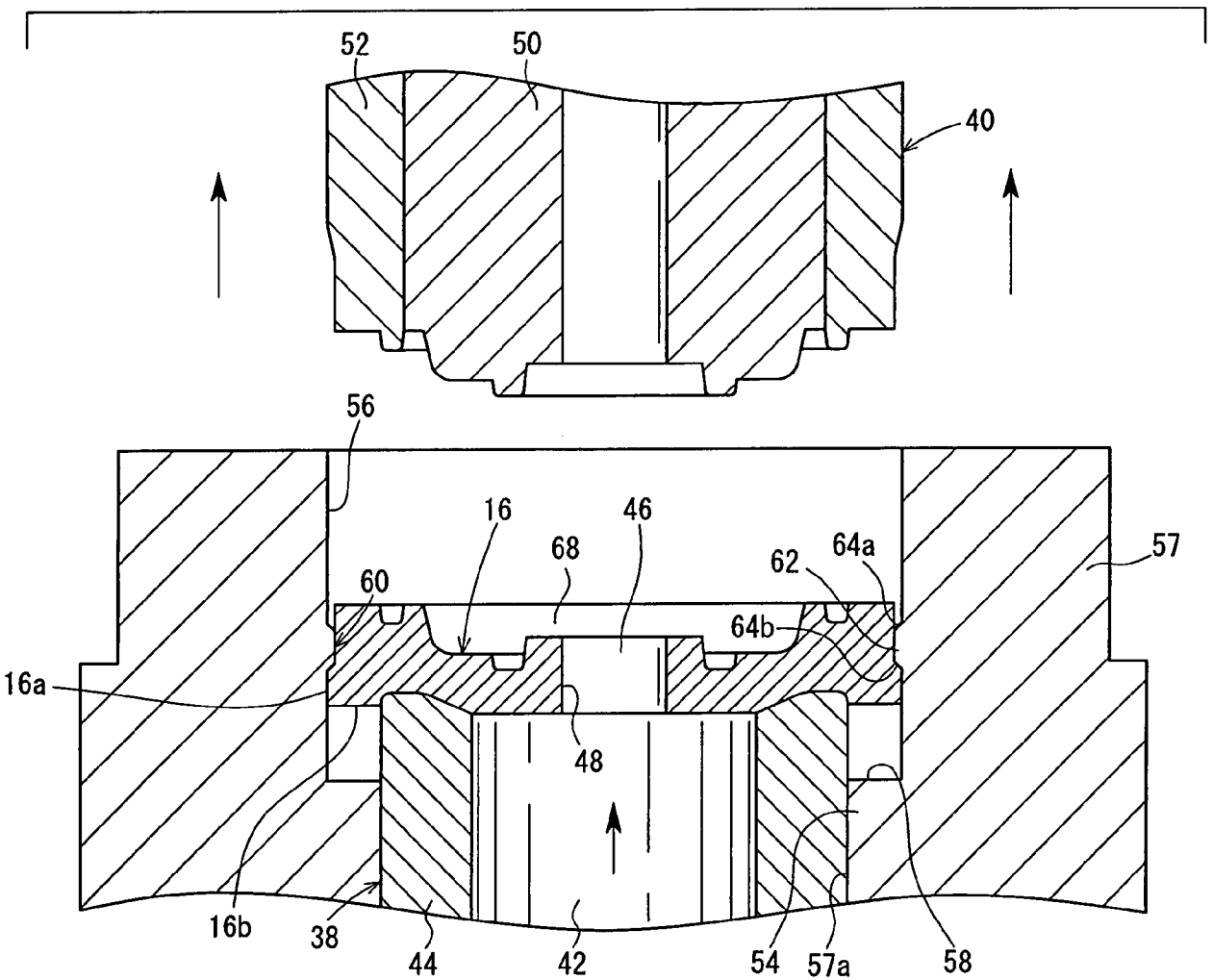
FIG. 4 is an enlarged fragmentary vertical cross-sectional view showing the manner in which the upper die illustrated in FIG. 3 is released from the workpiece, and the workpiece is lifted by a lower die and squeezed by a squeezer.

Then, as shown in FIG. 4, the actuator 14 is displaced upwardly by the non-illustrated drive source, displacing the upper die 40 upwardly. After the upper die 40 is displaced upwardly, the ejecting member 20 (see FIG. 1) is axially displaced upwardly by the non-illustrated drive source.

When the ejecting member 20 is displaced upwardly, it pushes the lower die 38 upwardly, pushing the workpiece 16 placed on the upper surface thereof upwardly from the workpiece cavity 68. At this time, the second lower die 44 slides along the inner circumferential surfaces of the base 24 and the ledge 54 of the outer ring 57.

As the workpiece 16 is displaced upwardly, the outer circumferential surface 16*a* of the workpiece 16 is progressively squeezed radially inwardly by the lower tapered surface 64*b* of the squeezer 60. The continued upward displacement of the workpiece 16 causes the outer circumferential surface 16*a* to be squeezed by the squeezer 60 into a surface extending substantially parallel to the inner circumferential surface 56 of the outer ring 57 and having a substantially constant diameter. Since the inner diameter of the flat surface 62 of the squeezer 60 is identical to the desired outside diameter of the workpiece 16, the outside diameter of the workpiece 16 that is squeezed by the squeezer 60 has desired dimensional accuracy.

The flat surface 62 of the squeezer 60 is substantially parallel to the inner circumferential surface 56 of the outer ring 57, and the inner circumferential surface 56 is substantially perpendicularly to the forming surface 58. Therefore, the perpendicularity between the outer circumferential surface 16*a* of the squeezed workpiece 16 and the lower surface 16*b* of the workpiece 16 which is formed by the forming surface 58 is improved.

Figure 5:
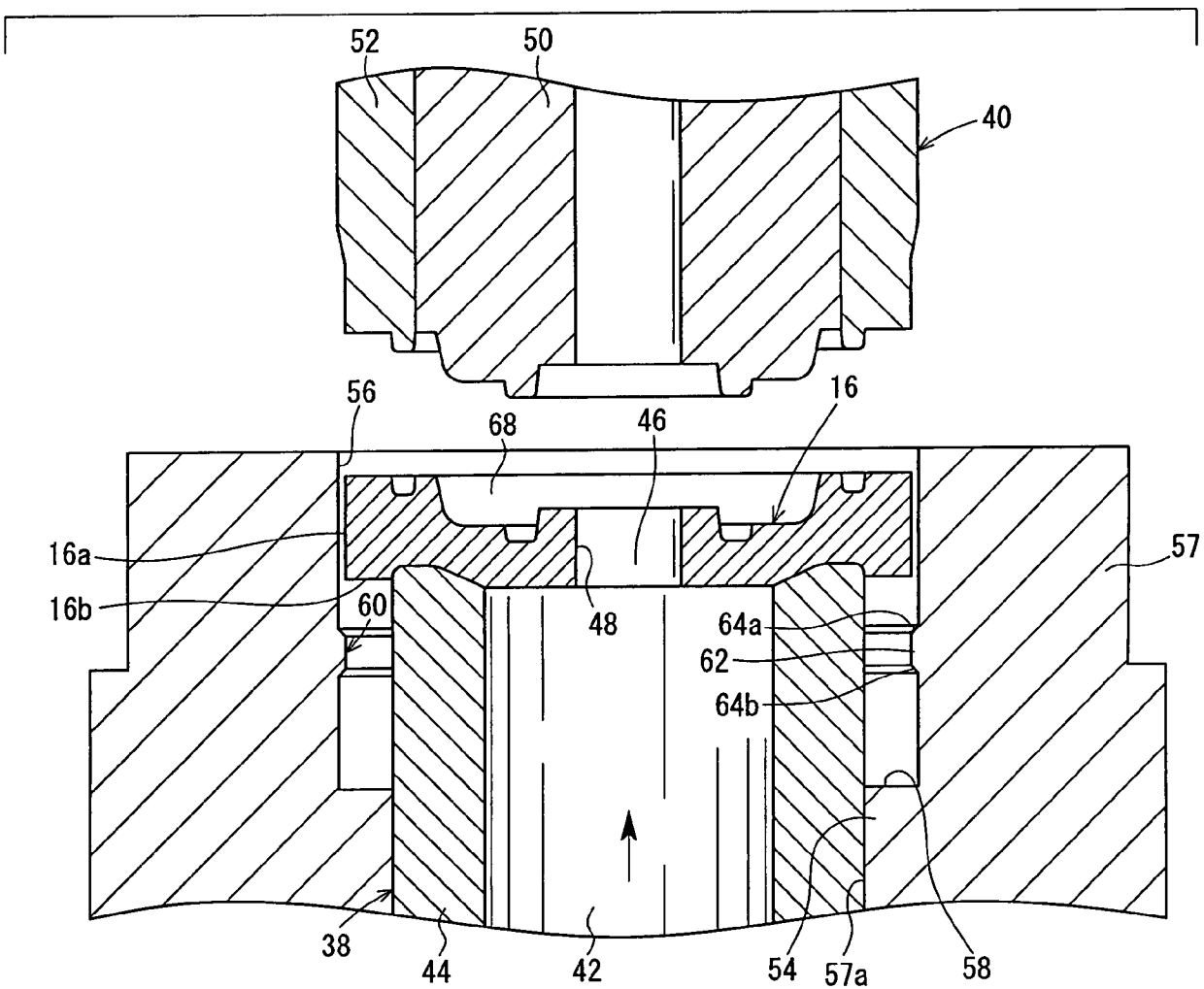
FIG. 5 is an enlarged fragmentary vertical cross-sectional view showing the manner in which the workpiece illustrated in FIG. 4 is pushed upwardly and removed from the outer ring.

When the ejecting member 20 is further displaced upwardly by the non-illustrated drive source, displacing the workpiece 16 further upwardly, the outer circumferential surface 16*a* of the workpiece 16 is spaced upwardly from the squeezer 60, as shown in FIG. 5. As a result, the outer circumferential surface 16*a* of the workpiece 16 which is squeezed by the squeezer 60 achieves desired dimensional accuracy, i.e., desired circularity.

Because the workpiece 16 is pushed upwardly by the ejecting member 20, the workpiece 16 that has been forged into a desired product shape can easily be removed from the workpiece cavity 68.

According to the present embodiment, as described above, the ledge 54 of the outer ring 57 has the flat upper forming surface 58 which is substantially perpendicular to the inner circumferential surface 56 of the outer ring 57, and when the workpiece 16 is pressed downwardly by the upper die 40, the outer circumferential surface 16*a* of the workpiece 16 is held against the inner circumferential surface 56 and the lower surface 16*b* of the workpiece 16 is held against the forming surface 58. As a result, the perpendicularity between the outer circumferential surface 16*a* of the workpiece 16 which is formed by the inner circumferential surface 56 of the outer ring 57 and the lower surface 16*b* of the workpiece 16 is increased, thereby increasing dimensional accuracy of the outer circumferential area of the workpiece 16.

Furthermore, when the lower die 38 is displaced upwardly by the ejecting member 20, the outer circumferential surface 16*a* of the workpiece 16 is squeezed by the squeezer 60 that projects a predetermined distance radially inwardly from the inner circumferential surface 56 of the outer ring 57. As a result, the outer circumferential surface 16*a* of the workpiece 16 that has been forged is squeezed to desired dimension with high accuracy without the need for a separate machining process. After the workpiece 16 is forged into a desired forged product, the outer circumferential surface 16*a* does not need to be additionally machined, and hence machining tools for additionally machining the squeezed outer circumferential surface 16*a* is not required. Consequently, the cost required for facility investment is reduced, and the process of manufacturing a forged product from the workpiece 16 is shortened.

The process of manufacturing the workpiece 16 is also shortened because the perpendicularity between the outer circumferential surface 16*a* and the lower surface 16*b* of the workpiece 16 is improved and the accuracy of the outside diameter of the workpiece 16 is increased all in one processing step performed by the single apparatus 10.

Although a certain preferred embodiment of the present invention has been shown and described in detail, it should be understood that various changes and modifications may be made therein without departing from the scope of the appended claims.

What is claimed is:

1. A method of forming a forging blank, comprising the steps of:

loading a workpiece into a die assembly having an upper die and a lower die;

actuating said upper die to press said workpiece loaded in said die assembly axially toward said lower die to cause material of an outer circumferential surface of said workpiece to flow into contact with an inner circumferential surface of said die assembly while pressing an end face of said workpiece against a placing surface of said die assembly which is substantially perpendicular to said inner circumferential surface thereof;

displacing said upper die away from said workpiece; and thereafter, actuating said lower die to press said workpiece axially toward said upper die to cause a squeezer projecting from said inner circumferential surface of the die assembly to squeeze said outer circumferential surface of said workpiece so that said workpiece has a substantially constant diameter.

2. A method according to claim 1, wherein said step of actuating said lower die comprises the steps of:

squeezing progressively said outer circumferential surface of said workpiece radially inwardly by a tapered surface of said squeezer to cause the material of said outer circumferential surface of said workpiece to flow downwardly; and squeezing said outer circumferential surface of said workpiece by a flat surface of said squeezer adjacent to said tapered surface so that said workpiece has a substantially constant diameter.

3. An apparatus for forming a forging blank, comprising:

an actuator;

a body assembly;

an upper die displaceable axially by said actuator;

a lower die disposed in said body assembly facing said upper die; and a die disposed around said upper die and said lower die, for placing said workpiece therein;

said die having a flat placing surface for placing said workpiece thereon, said flat placing surface projecting radially inwardly from an inner circumferential surface of said die across a clearance defined around said workpiece placed in said die;

a squeezer disposed on and projecting radially inwardly from said inner circumferential surface of said die facing an outer circumferential surface of said workpiece, wherein said inner circumferential surface of said die is substantially perpendicular to said placing surface, and wherein the apparatus is adapted, in a single operation, to simultaneously:

flatten a portion of an end face of said workpiece and said outer circumferential surface of said workpiece;

arrange said portion of said end face of said workpiece substantially perpendicular to said outer circumferential surface of said workpiece, and form a final outer circumferential dimension of said workpiece.

4. An apparatus according to claim 3, wherein said squeezer comprises:

a flat surface substantially parallel to said inner circumferential surface of said die; and a pair of tapered surfaces spreading from said flat surface progressively toward said inner circumferential surface of said die;

said flat surface and said tapered surfaces extending in an axial direction of said die.

5. An apparatus according to claim 4, wherein said squeezer has an inside diameter which is substantially the same as the outside diameter of said workpiece which is formed as said forging blank.

6. An apparatus according to claim 3, wherein said lower die comprises a first lower die having a guide for being inserted in a hole defined in said workpiece and a second lower die disposed around said first lower die for displacement along said body assembly.

7. An apparatus according to claim 3, further comprising an ejecting member disposed in said body assembly for ejecting said workpiece from a workpiece cavity defined by said die and said lower die.

8. An apparatus according to claim 3, wherein said clearance is defined substantially uniformly between said die and said workpiece in a circumferential direction of said workpiece.

9. An apparatus according to claim 3, wherein said upper die has an end face facing said workpiece, said end face being complementary in shape to an end face of said workpiece which faces said upper die.

10. An apparatus according to claim 3, wherein said lower die has an end face facing said workpiece, said end face being complementary in shape to an end face of said workpiece which faces said lower die.

11. An apparatus according to claim 3, wherein said end face of said workpiece is placed on said placing surface of said die, and said end face is formed to a flat shape by said placing surface when said workpiece is pressed by said upper die.

* * * * *